United States Patent [19]

Johnson

[11] 3,973,730

[45] Aug. 10, 1976

[54] APPARATUS FOR APPLYING REFRACTORY COATING TO THE ROOF LININGS OF ELECTRIC ARC FURNACES

[76] Inventor: John David Johnson, P. O. Box 300, Montpelier, Iowa 52759

[22] Filed: June 25, 1975

[21] Appl. No.: 590,068

[52] U.S. Cl. ..... 239/186; 239/227; 118/323

[51] Int. Cl.[2] ..... B05B 3/18

[58] Field of Search ..... 239/227, 186, 187, 280; 118/306, 317, 323

[56] References Cited

UNITED STATES PATENTS

| | | | |
|---|---|---|---|
| 2,710,225 | 6/1955 | Richards | 239/186 |
| 3,221,994 | 12/1965 | Chappell | 239/186 |
| 3,473,737 | 10/1969 | Bowman | 239/280 X |
| 3,797,745 | 3/1974 | Haus | 118/317 X |
| 3,799,445 | 3/1974 | Marino | 118/317 X |

*Primary Examiner*—Ronald Feldbaum
*Attorney, Agent, or Firm*—Henderson, Strom & Sturm

[57] ABSTRACT

An upstanding support affixed to the floor of a plant adjacent an electric-arc furnace and having a truss member rotatably attached thereto. The truss member at its free end has a vertical support member rotatably attached thereto and upstanding therefrom. The vertical support at its upper end has affixed thereto a radius arm member. The radius arm has the same radius of curvature as the roof lining of the electric-arc furnace. A refractory spraying unit is attached to, and is movable back and forth along the length of, the radius arm. When the roof of the electric-arc furnace is swung outwardly of the furnace between heats, the truss is swung about the upstanding support to carry the vertical support and radius arm directly beneath the furnace roof. Rotation of the radius arm and movement of the spraying unit along the length of the radius arm causes the roof lining to be coated with refractory.

10 Claims, 7 Drawing Figures

APPARATUS FOR APPLYING REFRACTORY COATING TO THE ROOF LININGS OF ELECTRIC ARC FURNACES

BACKGROUND OF THE INVENTION

This invention relates generally to steel making furnaces and the refractory linings thereof and more particularly to the repair of the refractory linings of top-charging electric furnaces.

The distinguishing feature of electric furnaces is the use of an electric arc to generate heat to melt and refine steel. The Heroult-type furnace is the dominant electric furnace. The furnace consists basically of a shell and refractory linings. The shell is cylindrical in shape, having a dome roof and a flat bottom. The bottom is lined with brick refractories, normally fireclay and silica or magnesite bricks, and a granular refractory is sintered into place over the refractory bricks to form the working bottom or hearth of the furnace. The cylindrical wall and the dome roof of the shell are also lined with refractory bricks, normally or silica. The dome roof and its refractory lining have a definite radius of curvature.

The furnace is mounted on toothed rockers which rest on and intermesh with toothed rails, and a motor rack-and-pinion mechanism can tilt the furnace in two directions, one for pouring and the other for slagging. A slagging door and a pouring spout are provided on opposite sides of the furnace. In the crown, or center, section of the dome roof, apertures for receiving electrodes, normally three, are provided and have water-cooled rings affixed thereover. The electrodes themselves are gripped by spring clamps affixed to the free ends of supporting arms, which arms are affixed to masts which raise or lower the arms and hence the electrodes.

Heroult electric furnaces are either door charging, a door for charging being provided in the side of the furnace, or top-charging, the dome roof being lifted and either swung to one side by motor-driven or hydraulic equipment or moved away by a gantry crane which travels on rails. We are here concerned with top-charging electric furnaces.

After the furnace has been charged, the dome roof is swung back over the furnace. The electrodes are lowered by the masts, through the apertures in the dome roof, to project into the interior of the furnace. The furnace is actuated, and current arcs directly from one electrode, into the metal or bath, therefrom to a second electrode, back into the bath, and then to a third electrode, in what is known as a direct-series arc. After the particular steelmaking process has been completed, the electrodes are raised, the power turned off, and the steel tapped into ladles. Thereafter, before the next heat, the dome roof is swung outwardly from the furnace, and the refractory lining of the roof is checked. Repair patching of the lining is done immediately to allow the refractory patching material to be sintered into place by the heat of the furnace.

The roof of an electric furnace is subjected to very high temperatures and great abrasion. Particularly severe localized high temperatures and corrosion or erosion occur in the crown section, through which the electrodes penetrate the furnace. High alumina refractory bricks have been developed for use in the crown section such that the life of the crown section more nearly approximates that of the rest of the roof lining.

Nevertheless, the roof lining of the electric arc furnaces must still be attended to between heats to ensure a reasonable lifetime for the lining. A fast and efficient way of doing this has not been developed, the structures which have been developed so far for spraying refractory coating being adapted for use with concentric types of vessels, having an open end, known as basic oxygen furnaces.

SUMMARY OF THE INVENTION

An apparatus, for applying refractory coating to the roof lining of a swing type, top-charging electric-arc furnace, is provided having a main support affixed to the floor and other structures of the factory adjacent the furnace. A truss is attached to the main support and is rotatable about the support in a horizontal plane. A vertical support is rotatably attached to the free end of the truss, the vertical support being rotatable about its longitudinal axis. A radius arm is affixed to the upwardly extended end of the vertical support and has a radius of curvature which is the same as that of the lining of the dome roof of the furnace. A spraying unit is attached to the radius arm, upwardly directed therefrom, and is movable back and forth along the length of the radius arm. When the roof of the furnace is swung outwardly from the furnace, the truss is swung around the main support to position the vertical support and radius arm directly beneath the furnace roof. The spraying unit is moved along the length of the radius arm, and the radius arm is rotated by the vertical support, every area of the dome roof lining being coated with refractory thereby.

It is an object of this invention to provide a novel apparatus for applying refractory coating to the linings of furnaces, and particularly to the roof linings of electric arc furnaces, for extending the useful life of the furnace linings.

It is another object of this invention to provide an apparatus which can accomplish the aforementioned object swiftly and with great thoroughness and efficiency.

A further object of this invention is to provide an apparatus which forms an arcuate path, having a radius of curvature identical to that of the dome roof lining of an electric arc furnace, and which carries a spraying unit back and forth along the path while rotating the path, thereby providing a more efficient and thorough application of refractory coating to the dome roof lining.

Yet another object of this invention is to provide a safer apparatus for applying refractory coating by locating the operator and controls remote from the heat of the furnace.

Still another object is to provide an apparatus for accomplishing the aforementioned objects which can be constructed for adaptation to and assembly into a variety of plant structure situations.

These objects and other features and advantages of this invention will become readily apparent upon referring to the following description, when taken in conjunction with the appended drawings.

BRIEF DESCRIPTION OF THE DRAWINGS

The apparatus for applying refractory coating is illustrated in the drawings wherein.

DESCRIPTION OF THE PREFERRED EMBODIMENT

Figure 1:
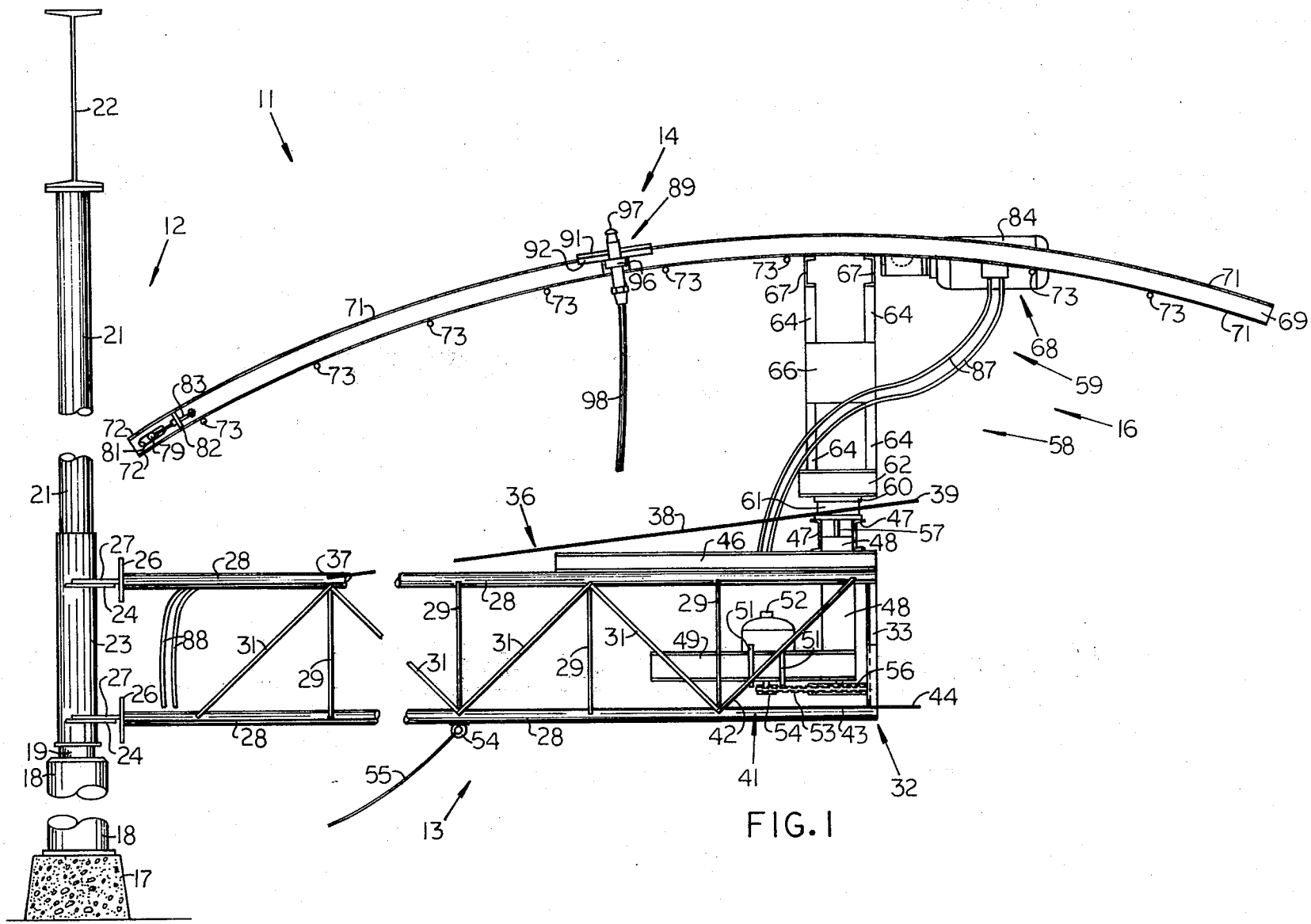
FIG. 1 is a foreshortened side elevational view.

Referring now to the drawings, the apparatus for applying refractory coating is indicated generally at 11 in FIG. 1. More particularly, the apparatus 11 includes a main upstanding support 12, a truss member 13, a unit for spraying refractory coating 14 and a unit 16 for holding and moving the refractory spraying unit 14.

The main support 12, shown in FIG. 1, has a bottom support 17 affixed to the floor of the plant. A shaft 18 is attached to the support 17 and extends upwardly therefrom. A collar member 19 is affixed to the top of the shaft 18, and a reduced shaft 21 is received by the collar 19 and shaft 18. A top support 22 is attached between the top of reduced shaft 21 and the ceiling, wall or some other structure of the plant. The length of the shafts 18,21 and the configuration of bottom and top supports 17,22 may be varied to adapt to the arrangements of different plants.

The truss member 13 is illustrated in FIGS. 1-4. The truss 13 includes a sleeve 23, FIGS. 1 and 3, which is rotatably attached to the main support 12, fitting over the reduced shaft 21 and resting upon the collar 19. The sleeve 23 has upper and lower arcuate plates 24 (FIG. 2) perpendicularly affixed thereto. Support plates 26, having brackets 27 affixed normal thereto, are attached to the plates 24, the brackets 27 being bolted or welded to the plates 24. The plates 26 are in a vertical plane, parallel to the main support 12, and are elongated in the horizontal direction.

Figure 2:
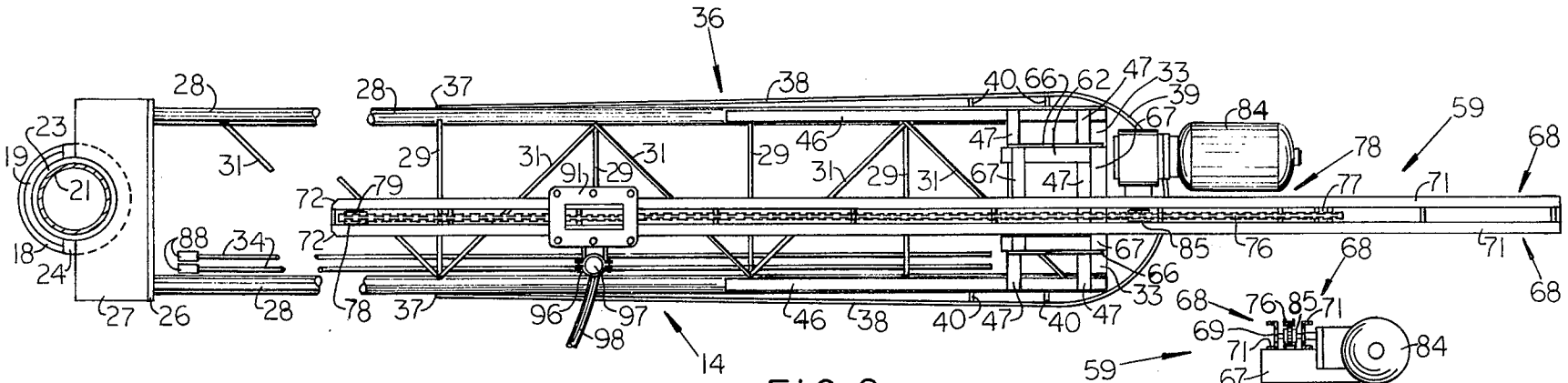
FIG. 2 is a foreshortened top plan view of the apparatus, part of the upstanding support being shown in section, and the electric motor on the truss being cut away for greater clarity.
Figure 4:
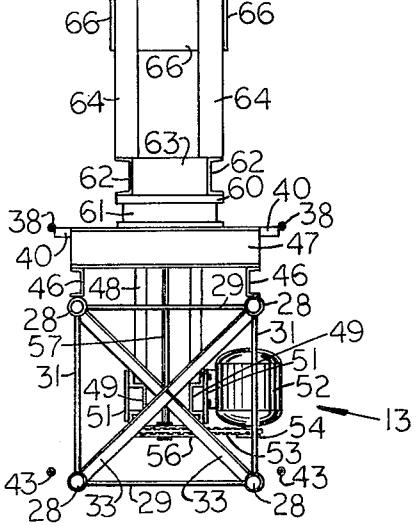
FIG. 4 is a fragmentary end elevational view showing the attachment of the vertical support member to the truss, parts of the truss and radius arm being in section.
Figure 3:
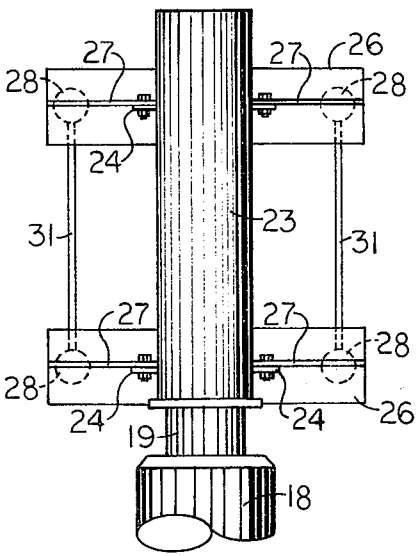
FIG. 3 is an enlarged, fragmentary end elevational view showing the attachment of the truss to the main support.

An elongated main pipe 28 is attached at each end of the plates 26, the four pipes 28 being parallel and horizontally disposed. The pipes 28 are uniformly spaced such that the space enclosed by the pipes 28 is square in cross section. The pipes 28 are interconnected and supported by horizontally and vertically disposed transverse supports 29 and diagonal supports 31. At the outwardly extended end 32 of the truss 13, the pipes 28 are interconnected by crossed diagonal end supports 33, FIG. 4. A pair of control hose pipes 34, FIG. 2, are attached to the upper horizontally disposed transverse and diagonal supports 29,31, extending along the length of, parallel and adjacent to, the upper left main pipe 28, when viewed from extended end 32. An upper guard member 36, FIGS. 1,2 and 4, is attached to the upper main pipes 28. Each end 37 of the guard 36 is attached to one of the upper pipes 28, and extending along the length of the upper pipes 28, but upwardly and outwardly therefrom, a straight portion 38 extends from each end 37. An arcuate portion 39, FIG. 2, curving around the extended end 32 of the truss 13, joins the straight portions 38, the guard 36 being continuously formed between its ends 37. Support members 40 connect the straight portions 38 to the upper pipes 28. A lower guard member 41 similarly is attached to the lower pipes 28, being attached at each end 42 to one of the lower pipes 28 and having straight portions 43 extending from the ends 42 which are interconnected by an arcuate portion 44 curving around the extended end 32.

Elongated support irons 46, FIGS. 1 and 4, are affixed to the tops of the upper pipes 28 adjacent the outer end 32. A pair of transverse support irons 47 are affixed across the support irons 46, adjacent extended end 32. Two vertical hanger members 48 are connected at their upper ends between the transverse supports 47 and at their lower ends have horizontally disposed motor mount members 49 attached thereto. The mounts 49 are parallel to the pipes 28, extend toward main support 12, and have strap members 50 for affixing the electric motor 51 thereto. The drive chain 52 is engaged by the motor shaft 53 and engages the cog wheel 56 of the drive shaft 57 for the rotation of unit 16.

Ring members 54 are affixed to the lower main pipes 28 intermediate their ends. Cords 55 are passed through the rings 54 and are wound upon winches (not shown), which operate upon the cords 55 to swing the truss 13 about the main support 12.

The unit 16, FIGS. 1 and 4, includes a vertical support member 58 and a radius arm member 59. The vertical support 58 includes a vertically disposed driveshaft 57, extending downwardly between the transverse supports 47, the hangers 48 and the mounts 49 to terminate in a cog wheel 56. The driveshaft 57 extends upwardly to terminate in a rotatable mounting 60 for the unit 16. The mounting 60 is held by a housing 61 affixed to the transverse supports 47. Parallel channel irons 62 are connected at their ends by transverse plates 63, the irons 62 and plates 63 being attached to the mounting 60. Vertical irons 64, attached near each end of the irons 62, are uniformly spaced and extend upwardly. Three support plates 66 join the irons 64, two side plates 66 and one plate 66 facing toward the forward portion of the radius arm 59. Horizontal supports 67 are attached across the tops of the vertical irons 64.

Figure 6:
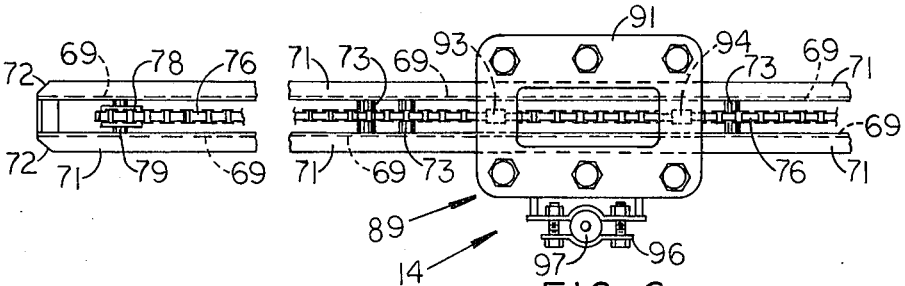
FIG. 6 is an enlarged, fragmentary foreshortened top plan view of the radius arm with the platform and nozzle.
Figure 7:
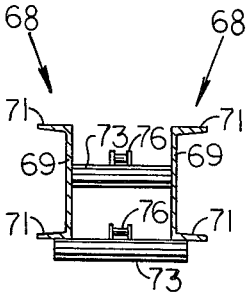
FIG. 7 is an enlarged, cross sectional view of the radius arm taken along line 7—7 in FIG. 5.

The radius arm member 59 of unit 16 includes a pair of curved channel members 68 disposed in side-by-side relationship. Each channel 68, FIG. 7, includes an upright portion 69 having upper and lower flanges 71. The flanges 71 are formed normal to the upper and lower edges of the portion 69, extend to one side of the portion 69 and along the whole length of the channel 68. The flanges 71 have tapered front portions 72, as shown in FIGS. 2 and 6. The channels 68 are joined together by transverse bars 73, an upper row of bars 73 extending between upright portions 69 and a lower row of bars 73 extending across the lower flanges 71, as shown in FIGS. 5 and 7.

The radius arm 59 is attached to the vertical support 58, the curved channels 68 being attached to the horizontal supports 67. The radius arm 59 forms an arcuate path, two-thirds of the radius arm 59 extending forward of the vertical support 58 and one-third to the rear thereof. As shown in FIGS. 2 and 4, the radius arm 59 is oriented substantially perpendicular to the horizontal supports 67 and is mounted thereon in offset fashion, being mounted adjacent the left ends of the horizontal supports 67 when looking from the rear toward the front of the radius arm 59. The curved channels 68, and hence the radius arm 59, have a distinct radius of curvature.

The radius arm 59 includes a conveyor assembly, indicated generally at 74 in FIG. 2. The assembly 74, FIGS. 2 and 6, includes an endless chain 76, supported by the upper and lower rows of transverse bars 73 (FIG. 7) and rear and front sprockets 77,78. The front sprocket 78 is mounted upon a bar 79 which extends through, and is slidable along the length of, slots 81 formed in the forward ends of the curved channels 68. Plates 82, extending between upper and lower flanges 71 have threaded apertures which receive adjustment bolts 83. One end of each bolt 83 is affixed to the bar 79. An electric motor 84, mounted to the channel members 68 and the rear horizontal support 67, engages the chain 76 at 85. One portion 87 of control hose extends from the motor 84, down the vertical support 58, to the ends of pipes 34 adjacent extended end 32. A second portion 88 of control hose extends from the opposite ends of the pipes 34 through a control panel (not shown).

Figure 5:
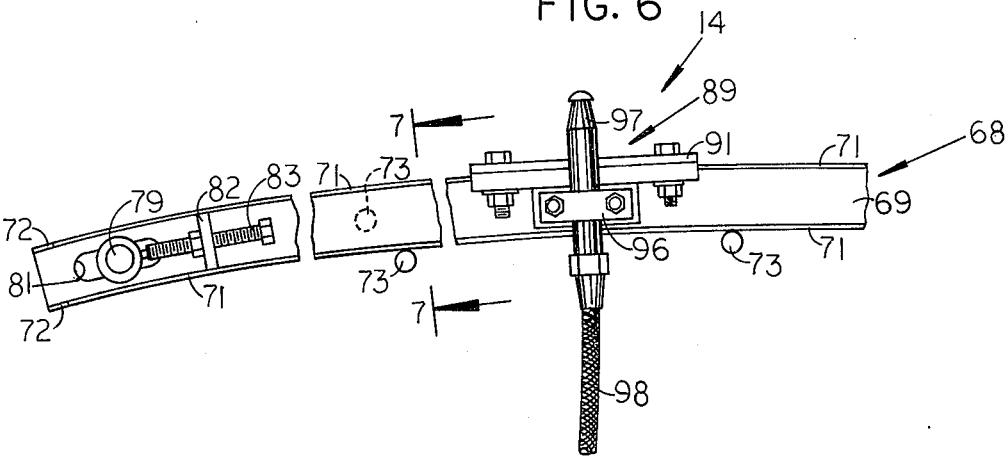
FIG. 5 is an enlarged, fragmentary foreshortened side elevational view of the radius arm carrying the platform bearing the nozzle.

The unit 14 for spraying refractory coating, best illustrated in FIGS. 5 and 6, includes a platform member 89 having top and bottom portions 91,92. The top portion 91 fits across the top flanges 71 of the channels 68, and bottom portions 92 are bolted to each side of the top portion 91, the top flanges 71 being caught between the portions 91,92 in a sliding fit such that the platform is movable over the arcuate path formed by the radius arm 59. The chain 76 is attached to the underside of top portion 91 at the front 93 and rear 94. A bracket 96 is attached to the left side of the platform 89, as viewed looking from the rear toward the front of the radius arm 59. A nozzle 97 is held perpendicular to the platform 89 by the bracket 96 and therefore outwardly along the radius of curvature of the radius arm 59. A refractory hose 98 is attached to the lower end of the nozzle 97 and depends therefrom, resting against the upper and, sometimes, the lower guards 36,41, and passing through the control panel (not shown).

Before the apparatus for applying refractory coating 11 can be used in a steel making plant having top-charging electric arc furnaces, it must first be appropriately located. The upstanding support 12 is situated proximate to the furnace. The conformation of the bottom and top supports 17,22 and the length of the shafts 18,21 are adapted to the existing structure of the plant. The sleeve 23 is fitted over shaft 21 before the top support 22 is affixed, the shaft 18 having been made of a length sufficient to support the collar 19, and therefore the truss 13, at the appropriate height above the plant floor. The length of the truss 13 is sufficient to carry the units 14 and 16 directly beneath the roof of the furnace after it has been swung outwardly of the furnace between heats. The radius arm 59 is constructed to have a radius of curvature identical to that of the roof lining of the plant furnaces and a length sufficient to carry the spraying unit 14 underneath the edge of the furnace roof. The control panel for the apparatus 11 is located in a cabinet remote from the apparatus 11 to protect the operator from the intense heat.

When the apparatus 11 is used, the roof of the furnace is swung outwardly of the furnace between heats. The winches are actuated and operate on the cords 55 to swing the truss 13 about main support 12. The spraying unit 14 and the unit 16 for holding and moving the spraying unit 14 are swung thereby underneath the roof of the furnace, the vertical support 58 being directly under the center of the roof. Through appropriate electric circuitry, not shown here, the electric motor 52 is operated from the control panel to rotate the vertical support 58 and attached radius arm 59. The electric motor 84 is operated to move the spraying unit 14 along the radius arm 59, the chain 76 drawing the platform 89 over the upper flanges 71. The control hose, running from the control panel through portions 87,88 and pipes 34, to the electric motor 84, controls the direction the platform 89 is moved along the radius arm 59. The platform 89 is moved back and forth over the arcuate path formed by the radius arm 59 while the path itself is rotated, and the nozzle 97 is brought to bear against all areas of the roof lining of the furnace thereby. The refractory hose 98 carries refractory coating to the nozzle 97 for spraying. The flow of refractory coating is regulated from the control panel as is the fineness of the refractory spray emerging from the nozzle 97.

The radius arm 59 may be rotated in either direction, and at variable speeds, 0–5 r.p.m. having been found to be a good working range. The speed and direction of rotation of the radius arm 59 are also regulated from the control panel. The spraying of the dome roof can take as little as five minutes, depending upon the size of the roof.

The dome roof lining of an electric arc furnace is thoroughly and swiftly coated by the operation of the apparatus 11. The operator of the apparatus 11 is located away from the heat of the furnace. The apparatus 11 can be constructed upon a variety of existing plant structures. Thus it can be seen that the objects of this invention have been attained.

Although a preferred embodiment has been disclosed herein, it is to be remembered that various modifications and alternate constructions can be made thereto without departing from the full scope of the invention, as defined in the appended claims.

I claim:

1. an apparatus, for applying refractory coating to the roof lining of a swing type, top-charging electric-arc furnace, comprising:

a main upstanding support affixed to the floor proximate to the furnace;

a truss member rotatably attached at one end to said main support and having an outwardly extended end;

means for spraying refractory coating; and means for forming an arcuate path having the same radius of curvature as the roof lining of the furnace and holding and moving said means for spraying back and forth along said arcuate path and simultaneously rotating said arcuate path, said means for forming, holding and moving being rotatably attached to said outwardly extended end, said truss member rotating about said main support to swing said means for forming, holding and moving directly under the roof of the furnace when the roof is swung outwardly from the furnace, whereby said means for spraying is held and moved along the roof lining proximate thereto to direct refractory coating thereon.

2. An apparatus for applying refractory coating as defined in claim 1 aand further wherein said means for forming, holding and moving includes a vertical support member and a radius arm member, said vertical support being rotatably attached to said outwardly extended end and having a top end extended upwardly therefrom, said radius arm being attached to said vertical support at said top end and having the same radius of curvature as the roof lining thereby forming said arcuate path.

3. An apparatus for applying refractory coating as defined in claim 2 and further wherein said means for spraying includes a platform member and a nozzle, said platform being attached to and movable along said radius arm, said nozzle being attached to said platform and oriented along a radius of curvature of said radius arm whereby said nozzle directs refractory coating upwardly onto the roof lining.

4. An apparatus for applying refractory coating as defined in claim 3 and further wherein said radius arm includes flange members extending outwardly from said radius arm on each side thereof and extending the length of said radius arm, said platform fitting over and traveling along said flanges.

5. An apparatus for applying refractory coating as defined in claim 4 and further wherein said radius arm includes an endless chain conveyor means supported between said flanges, said conveyor means engaging said platform to move said platform along the length of said radius arm.

6. An apparatus for applying refractory coating as defined in claim 3 and further wherein said means for spraying includes a refractory hose member attached to said nozzle for carrying refractory coating to said nozzle, and said truss member includes upper and lower guard members, each of said guard members being attached at one end to one side of said truss and extending outwardly therefrom along the length of said truss, curving around said outwardly extended end, and extending back along said truss, being attached at the opposite end to the opposite side of said truss, whereby said hose member is protected from entanglement with said truss.

7. An apparatus for applying refractory coating as defined in claim 5 and further wherein said conveyor means includes control hose members, and said truss includes pipe members for receiving said control hose members.

8. An apparatus for applying refractory coating as defined in claim 3 and further wherein said truss member includes intermediate its ends ring members affixed thereto, a cord member received through said ring members, and a winch member is provided to wind and unwind said cord, whereby said truss is rotated about said main support.

9. An apparatus for applying refractory coating as defined in claim 7 and further wherein a control panel is disposed remotely from said main support, said refractory hose member passing through said panel to said nozzle, said control hose having first and second portions, said first portions passing through said panel to attachment at one end of said pipe members, said second portions passing from the opposite end of said pipe members to said conveyor means, whereby said control panel regulates the flow of the refractory coating and the movement of said platform along said arcuate path.

10. An apparatus for applying refractory coating as defined in claim 9 and further wherein said conveyor means includes a first motor for driving said conveyor means, said second portions of said control hose being attached to said first motor, and said vertical support member includes a second motor for rotating said vertical support.

* * * * *